US005154024A

United States Patent [19]

Noel

[11] Patent Number: 5,154,024

[45] Date of Patent: Oct. 13, 1992

[54] FLOOR SINK/DRAIN INSTALLATION METHOD AND APPARATUS

[76] Inventor: John A. Noel, 1030 Birch Ave., Escondido, Calif. 92027

[21] Appl. No.: 762,614

[22] Filed: Sep. 19, 1991

[51] Int. Cl.[5] ..... E04D 13/00

[52] U.S. Cl. ..... 52/12; 210/163; 210/232

[58] Field of Search ..... 52/12, 34, 698, 699, 52/741-748, 126.7, 126.1, 365, 302, 303

[56] References Cited

U.S. PATENT DOCUMENTS

| | | | |
|---|---|---|---|
| 509,366 | 11/1893 | Drum . | |
| 782,867 | 2/1905 | Moore . | |
| 994,598 | 6/1911 | Martin . | |
| 2,264,082 | 11/1941 | Kintz . | |
| 2,520,450 | 9/1946 | Austin, Jr. . | |
| 2,539,323 | 1/1951 | Poittevin . | |
| 2,559,317 | 7/1951 | Perlstein . | |
| 2,716,757 | 12/1952 | Eriksson . | |
| 2,746,664 | 5/1956 | Strmic . | |
| 3,674,149 | 7/1972 | Donaldson | 210/163 |
| 4,107,929 | 8/1978 | Ebeling | 52/12 |
| 4,112,691 | 9/1978 | Ebeling | 52/12 |
| 4,216,790 | 8/1980 | Stoltz | 52/12 |
| 4,285,812 | 8/1981 | Stoltz | 52/12 |
| 4,423,527 | 1/1984 | Morris | 52/63 |
| 4,462,123 | 7/1984 | Morris | 52/126.2 |
| 4,492,491 | 1/1985 | Ebeling | 52/12 |
| 5,051,175 | 9/1991 | Walczak | 52/12 |

OTHER PUBLICATIONS

Page FD33 of "Hydromechanics Handbook . . . 691" by Zurn.

Commercial Enameling product brochure for floor sinks.

*Primary Examiner*—David A. Scherbel
*Assistant Examiner*—Beth Aubrey
*Attorney, Agent, or Firm*—Loyal M. Hanson

[57] ABSTRACT

A method of installing a floor fixture includes the step of providing a support structure for stabilizing the floor fixture relative to a floor foundation at an installation location. The method proceeds by coupling the floor fixture to a drainpipe at the installation location before a concrete floor is poured, stabilizing the floor fixture with the support structure, and pouring a concrete floor on the floor foundation while the support structure stabilizes the floor fixture. An apparatus for stabilizing a floor fixture includes a plate for coupling the body of the floor fixture to a plurality of legs extending to the floor foundation. The plate has a central opening such that the plate can be placed over the body of the floor fixture to a horizontal position in which the body of the floor fixture extends through the central opening. Components are provided for adjustably mounting the plate in such a position on the plurality of legs, and the central opening is either configured to mate with the cross sectional shape of the body of the floor fixture so that the plate abuts the body of the floor fixture or separate components are provided for coupling the plate to the floor fixture. The apparatus may be configured to mate with any of various conventional floor sinks and floor drains. One embodiment includes a baseplate on which a selected one of various adapter plates can be attached.

17 Claims, 5 Drawing Sheets

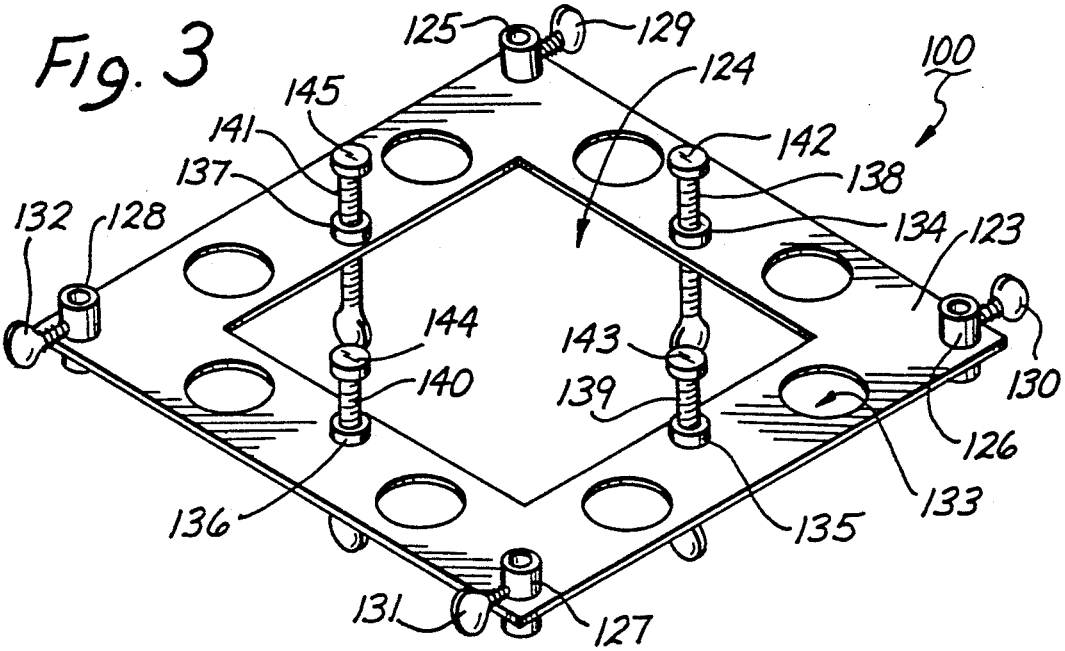
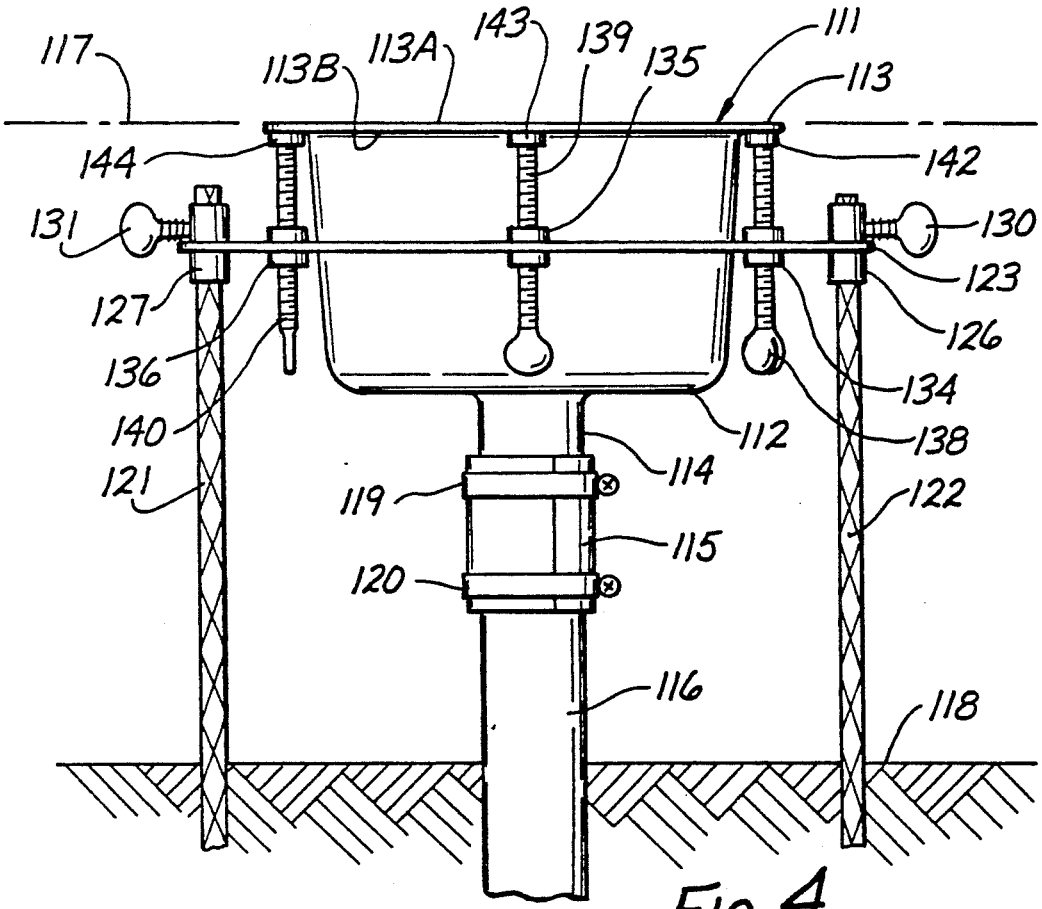
Fig. 4

FLOOR SINK/DRAIN INSTALLATION METHOD AND APPARATUS

BACKGROUND OF THE INVENTION

1. Technical Field

This invention relates generally to the installation of plumbing fixtures, and more particularly to a method and apparatus for installing floor fixtures such as floor sinks and floor drains.

2. Background Information

Recall that unlike other types of plumbing fixtures, floor sinks and drains install directly in a concrete floor. Once installed, the rim of the fixture lies flush with the upper surface of the floor. In that position, liquid at floor level flows directly into the fixture and through an outlet at the bottom to a drainpipe beneath the floor. Such fixtures find widespread use, and many floor fixtures appear in the concrete floors of buildings used for markets, restaurants, hospitals, and the like in order to comply with applicable building codes. So, the details of installation demand attention.

Consider existing methods of installation in a concrete floor. Before installation, plumbers run a drainpipe through trenching to each installation location. Then, workers establish a dirt grade (i.e., the floor foundation) on which the concrete floor is to be poured. After that, the floor fixture installer places a cardboard sleeve (e.g., a section of sauna tube) over each drainpipe. For installation of a one-foot square floor sink in a six-inch thick concrete floor, for example, the sleeve may measure about two feet in diameter and about one foot long. After placing a sleeve over each drainpipe, the installer carefully fills the sleeves with sand to prevent collapse during the process of pouring the concrete floor.

With a sand-filled sleeve in place over the drainpipe at each installation location, workers pour the concrete floor and finish it at a predetermined floor level. Some days later, after the concrete has set, the floor fixture installer undertakes the somewhat tedious operation of digging out the sand from each sleeve by hand and removing the sleeves, leaving a two-foot diameter hole in the concrete floor around each drainpipe and a pile of sand on the concrete floor adjacent the hole. Next, the installer mounts a floor sink or floor drain fixture at each location by placing it in the hole and coupling it to the drainpipe while maintaining the upper lip of the fixture flush with the upper surface of the concrete floor. The installer then carefully refills the hole with sand to within four to six inches of the upper surface of the concrete floor (depending on the thickness of the concrete slab). Next, the installer pours concrete in the hole and finishes it flush with the lip of the fixture and the concrete previously poured. Then, the installer cleans up the pile of excess sand remaining on the concrete floor.

Thus, installation involves several time-consuming steps: placing the sleeve, filling the sleeve, pouring the concrete, waiting for the concrete to set, digging out the sand, removing the sleeve, connecting the floor fixture, replacing some sand, pouring and finishing more concrete, and, or course, cleaning up the extra sand and discarding the used sleeve. Each of those activities increases project cost and so a need exists for a more efficient, less costly and less time-consuming way to install fixtures such as floor sinks and floor drains.

SUMMARY OF THE INVENTION

This invention alleviates the problem outlined above by connecting the floor fixture to the drainpipe before pouring the concrete floor. Installation proceeds using a structure to stabilize the fixture. An apparatus constructed according to the invention for that purpose includes a plate that fits over the body of the floor fixture and adjustably connects to legs extending to the floor foundation such as sections of sections of steel reinforcing bar driven into the floor foundation.

Thus, the method and apparatus of the invention simplify installation by eliminating the tedious operation of installing and removing protective sand-filled sleeves. In addition, they eliminate the cost, inconvenience, and time delays of an additional concrete pouring. Moreover, they simplify cleanup activities.

Generally, a method of installing a floor fixture according to the invention includes the step of providing a support structure for stabilizing the floor fixture at an installation location. The stabilizing plate subsequently described combines with legs in the form of sections of steel reinforcing bar as such a support structure. The method proceeds by coupling the floor fixture to a drainpipe at the installation location before pouring a concrete slab (i.e., a concrete floor) on the floor foundation. Next, the floor fixture is stabilized with the support structure and then the concrete floor is poured on the floor foundation while the support structure stabilizes the floor fixture, thereby covering the support structure with the concrete floor.

According to another aspect of the invention, there is provided an apparatus for stabilizing the floor fixture that includes a plate for coupling the body of the floor fixture to a plurality of legs extending to the floor foundation (preferably driven into the floor foundation). Dubbed a "stabilizing plate," it has a central opening such that the plate can be placed over the body of the floor fixture to a horizontal position in which the body of the floor fixture extends through the central opening. Suitable components adjustably mount the plate in such a position on the plurality of legs. The central opening is either configured to closely fit the cross sectional shape of the body of the floor fixture so that the plate abuts the body of the floor fixture in a stabilizing relationship, or separate components are provided for coupling the plate to the floor fixture, such as adjustable screw arrangements that an installer can manipulate to bear against the fixture.

These and other objects, features, and advantages of the invention will become more apparent upon reading the following detailed description with reference to the illustrative drawings.

BRIEF DESCRIPTION OF THE DRAWINGS

FIG. 3 is a pictorial view of a second stabilizer plate that includes upwardly extending screw arrangements for bearing against the lip of a floor fixture;

FIG. 4 is an elevation view of the second stabilizer plate installed over the body of a conventional floor sink;

DESCRIPTION OF THE PREFERRED EMBODIMENTS

Figure 1:
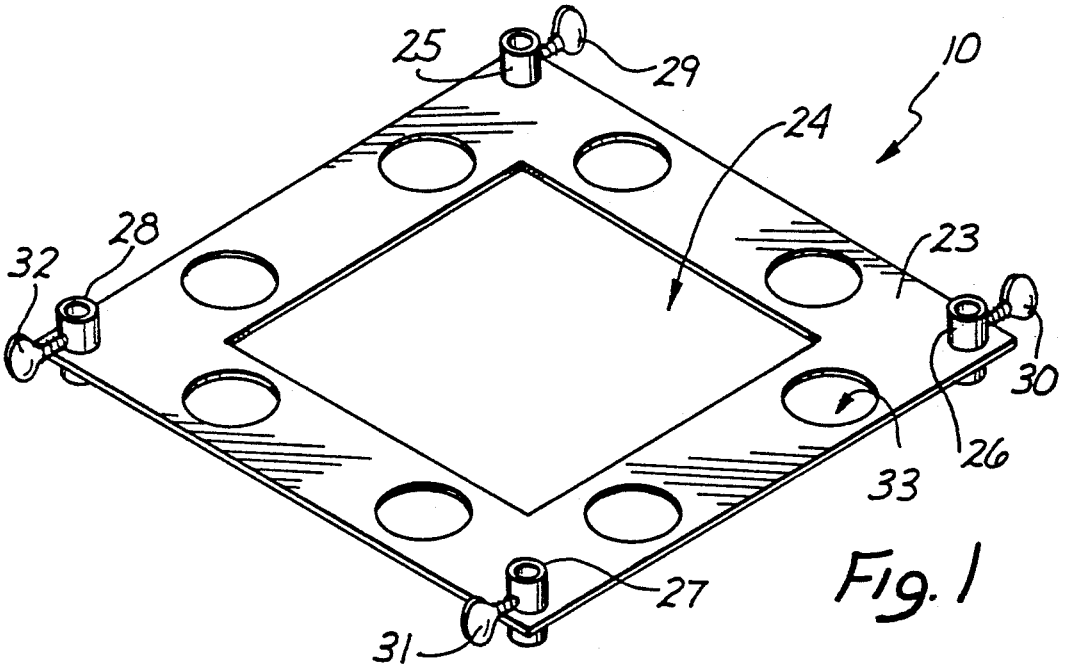
FIG. 1 of the drawings is a pictorial view of a stabilizing plate constructed according to the invention.
Figure 2:
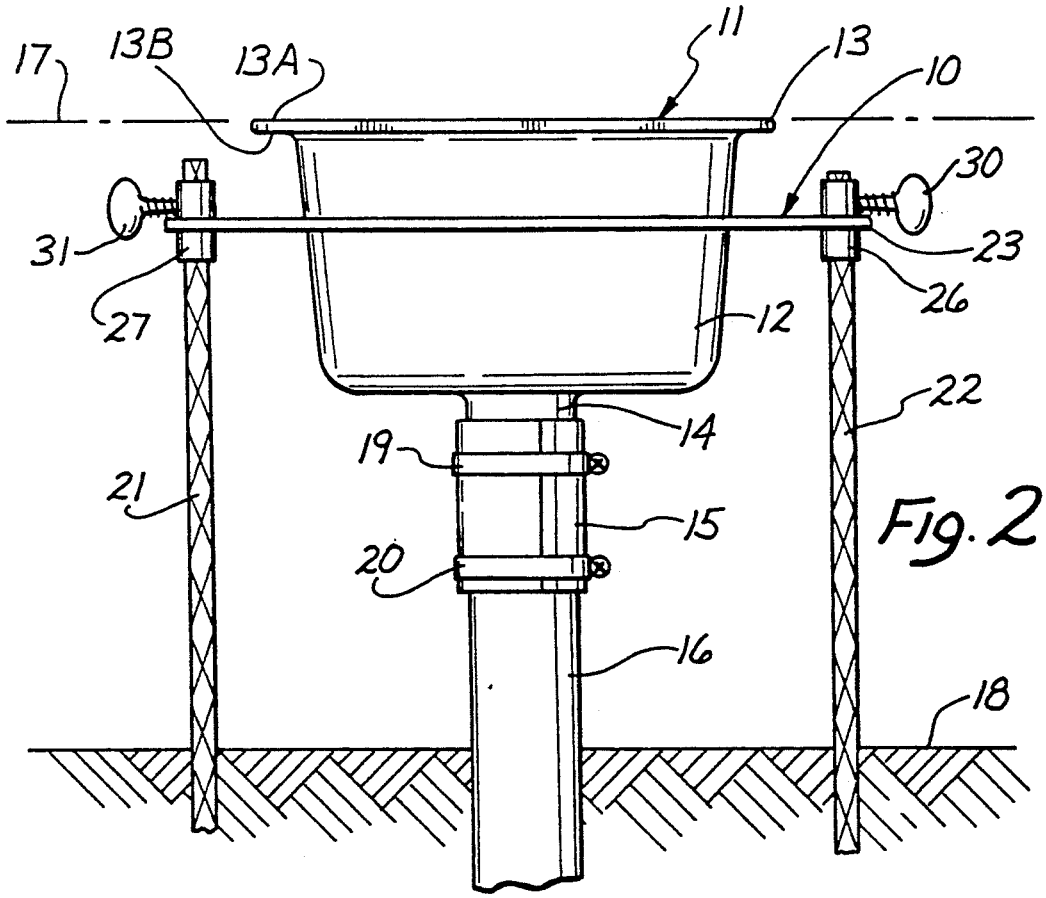
FIG. 2 is an elevation view of the plate installed directly over the tapered body of a conventional floor sink and mounted on four legs of steel reinforcing bar.

The drawings show a method for installing a floor fixture in a concrete floor and several embodiments of an apparatus for doing so. FIGS. 1 and 2 illustrate the method and one embodiment of the apparatus. The particular apparatus 10 illustrated is configured for use in stabilizing a floor fixture in the form of a conventional floor sink 11, and the floor sink 11 is illustrated in FIG. 2 as it would appear installed at an installation location in the floor of a supermarket under construction (or other installation location) prior to the concrete floor being poured.

The floor sink 11 includes a body 12 that extends downwardly from a lip 13 of the floor sink 11 to a drain outlet 14 (FIG. 2). Like the body of many conventional floor sinks, the body 12 has a generally square cross sectional shape. In other words, with the floor sink 11 in an installed position, the lip 13 lies in a horizontal plane and the cross sectional shape of the body in a horizontal plane is generally square. In addition, the body 12 of the particular floor sink 11 tapers inwardly as it extends downwardly to the drain outlet 14.

In the installed position illustrated in FIG. 2, the drain outlet 14 is coupled with a coupler 15 to a drainpipe 16 in a conventional manner so that an upperside 13A of the lip 13 is generally flush with a predetermined floor level 17. In that position, an underside 13B of the lip 13 faces downwardly toward a floor foundation 18 on which the concrete floor is to be poured. The floor sink 11 may, for example, take the form of the enamelled cast iron floor sink available from Commercial of Huntington Park, Calif. that is identified by its Catalog No. 908-3. In that event, the lip 13 measures about twelve inches square, and the body 12 tapers inwardly as it extends downwardly about eight inches from the underside 13B of the lip 13 to the level of the drain outlet 14. In addition, the drain outlet 14 is sized to mate with a three inch drainpipe so that the coupler 15 may take the form of a conventional coupler that clamps with band clamps 19 and 20 over the drain outlet 14 and the drainpipe 16 as illustrated. Of course, those precise dimensions are not critical within the broader inventive concepts disclosed, the support structure (and specifically the apparatus 10) being configured to accommodate the particular dimensions of the floor fixture to be stabilized.

The floor foundation 18 is prepared in a known way prior to pouring the concrete floor. Typically, it takes the form of natural earth that has been compacted where needed and finished to establish a finished grade. Although shown well below the coupling 15 for illustrative convenience, the level of the floor foundation 18 (i.e., the finished grade) might typically lie about ten inches below the predetermined floor level 17 and have a recess formed around the drainpipe 16 that provides sufficient working room to install the coupling 15. Six inches of fill sand (not shown) is typically placed on the finished grade before pouring the concrete floor, and that results in the concrete floor having a thickness of about four inches between the upper level of the fill sand and the predetermined floor level 17. In other words, when the installation of the floor sink 11 is complete, the concrete floor extends from the predetermined floor level 17 downwardly about four inches to the fill sand atop the floor foundation 18.

When installed alone on the drainpipe 16, the floor sink 11 is somewhat unstable and vulnerable to being jarred out of position by workers and equipment engaged in pouring the concrete floor. But, the inventive installation illustrated includes a supporting structure in the form of the apparatus 10 mounted on legs such as sections of steel reinforcing bar. That structure stabilizes the floor sink 11.

The apparatus 10 serves as means for coupling the body 12 of the floor sink 11 to a plurality of legs for stabilizing purposes, just two legs 21 and 22 are visible in FIG. 2 although the particular apparatus 10 illustrated is configured for use with four legs. In that regard, the apparatus 10 includes a plate 23 composed of a somewhat rigid material, such as a one-eighth inch to one-quarter inch thick, molded plastic material. The plate 23 defines a central opening 24 such that the plate 23 can be placed over the body 12 of the floor sink 11 to the generally horizontal position illustrated in FIG. 2. In that position, the body 12 extends through the opening 24 and so the plate 23 circumscribes the body 12 in a way that enables it to be used to restrain movement of the floor sink 11.

An apparatus constructed according to the invention includes means for coupling the plate 23 to the floor fixture 11 so that the plate 23 can restrain movement of the floor fixture 11. That may be accomplished in various suitable ways according to the broader inventive concepts disclosed. For the apparatus 10, the central opening 24 is configured to closely mate with the cross sectional shape of the body 12 so that the plate 23 abuts the body 12 when the plate 23 is placed in the illustrated position relative to the floor fixture 11.

In other words, as the installer moves the plate 23 upwardly over the body 12, a point is reached where the cross sectional shape of the tapered body 12 fits tightly within the opening 24 (preferably when the plate 23 is a distance below the upperside 13A of the lip 13 that is roughly equal to the thickness of the finished concrete floor). The plate 23 is configured so that the fit at that point is sufficiently tight to restrain horizontal movement of the fixture because the installed floor fixture is most vulnerable to horizontal forces. Preferably, the fit is sufficiently tight to provide upward support as well.

Installation may proceed by placing the plate 23 on the floor foundation 18 in a generally horizontal position such that the drainpipe 16 extends toward or through the central opening 24 in the plate 23. Next, legs are inserted through each of a plurality of collars 25–28 on the apparatus 10 and the legs are driven into the floor foundation 18. The legs may take the form of two to three foot sections of steel reinforcing bar driven a foot or so into the floor foundation 18. Next, the floor sink 11 is installed in the position illustrated by coupling the drain outlet 14 to the drainpipe 16. The plate 23 is raised to the illustrated position and secured to the legs in that position by tightening setscrews 29–32 in the collars 25–28. Of course, the floor sink 11 could be coupled to the drainpipe 16 and the plate 23 placed in the illustrated position before installing the legs without departing from the inventive concepts disclosed.

The illustrated plate 23 has a plurality of smaller openings in the form of holes extending through the collars 25–28, the apparatus 10 being molded of a plastic material so that the collars 25–28 are formed with the plate 23 in that position in unitary one-piece construction. The setscrews 29–32 are separate components, but they may also be molded of plastic. The collars 25–28 may also be separate components within the inventive concepts disclosed that are attached to the plate 23 by suitable means such as bonding after the plate is formed. The collars 25–28 may also take the form of separate components unattached to the plate 23 that are secured to the legs in positions just beneath the plate 23 so that the plate 23 rides on them. In any event, the collars 25–28 serve as means for adjustably mounting the plate 23 in the illustrated position on the plurality of legs.

As for the eight circular openings in the plate 23, such as the one designated with reference numeral 33 in FIG. 1, they simply facilitate molding in a known way apart from the inventive concepts disclosed. Concerning the overall size of the plate 23, it is sufficiently large to leave working room between the collars 25–28 and the body 12 of the floor sink 11 while being sufficiently small to resist significant bowing between the collars 25–28 and the body 12. Preferably, the plate 23 is so dimensioned that it extends horizontally from the body 12 less than the width of the floor fixture in order not to present an obstacle to workers and equipment engaged in pouring the concrete floor.

In line with the foregoing, the method of installing a floor fixture according to the invention may be restated as including the step of providing a support structure for stabilizing the floor fixture relative to a floor foundation at an installation location. The method proceeds by coupling the floor fixture to a drainpipe at the installation location before a concrete floor is poured on the floor foundation. Next, the floor fixture is stabilized with the support structure. Then, a concrete floor is poured on the floor foundation while the support structure stabilizes the floor fixture, thereby covering the support structure with the concrete floor.

FIGS. 3 and 4 illustrate another apparatus 100 constructed according to the invention. It is similar in many respects to the apparatus 10 and so only differences are described in further detail. For convenience, reference numerals designated parts of the apparatus 100 are increased by one hundred over those designating similar parts of the apparatus 10.

Similar to the apparatus 10, the apparatus 100 includes a plate 123 that defines a central opening 124. The plate 123 serves as means for coupling the body 112 of a floor fixture in the form of a floor sink 111 to a plurality of legs that extend to a floor foundation 118 at the installation location (only two legs 121 and 122 of four legs being visible in FIG. 4). But unlike the apparatus 10, the central opening 124 does not necessarily mate with the cross sectional shape of the body 112. Instead, the apparatus 100 includes a plurality of upwardly extending screw arrangements attached to the plate 123 at spaced apart locations adjacent the central opening 124 such that the screw arrangements can be adjustably brought to bear upwardly against an underside 113B of a lip 113 on the floor sink 111.

The upwardly extending screw arrangements serve as means for coupling the plate to the floor fixture. They may take any of various suitable forms within the broader inventive concepts disclosed, but each illustrated screw arrangement includes a collar attached to the plate 123 and a screw member extending through the collar. Accordingly, the apparatus 100 includes collars 134–137 and screw members 138–141 extending through them. Preferably, the collars 134–137 are molded with the plate 123 in unitary one-piece construction and the screws include snap-on pads 142–145 configured in a known way that provide a broad bearing surface against the underside 113B.

Installation proceeds in a manner similar to that for the apparatus 10. However, the plate 123 does not necessarily abut the body 112. Instead, the screw arrangements are adjusted to bear upwardly against the underside 113B of the lip 113. Of course, the plate 123 may be so configured that the central opening 124 mates with the body 111. Then, the plate abuts the body 111 as well, and it may do so sufficiently to provide vertical support. But the body of some commercially available floor sinks do not taper so that the upwardly extending screw arrangements provide the only upward support apart from the coupling to the drainpipe.

Figure 5:
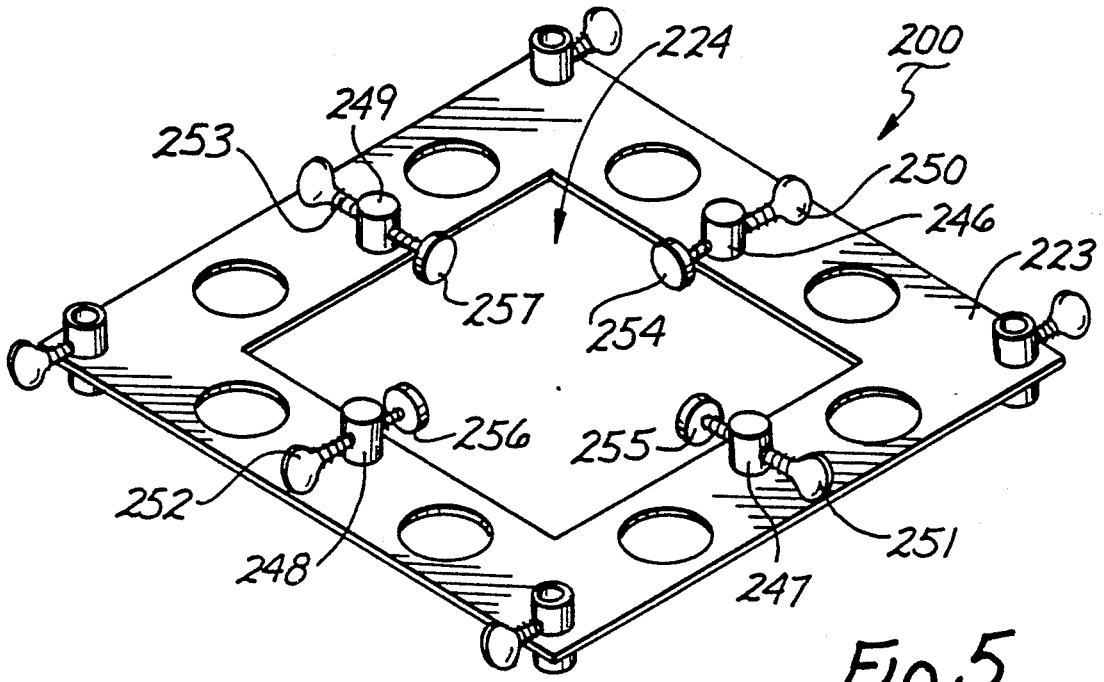
FIG. 5 is a pictorial view of a third stabilizer plate that includes inwardly extending screw arrangements for bearing against the body of the floor fixture.
Figure 10:
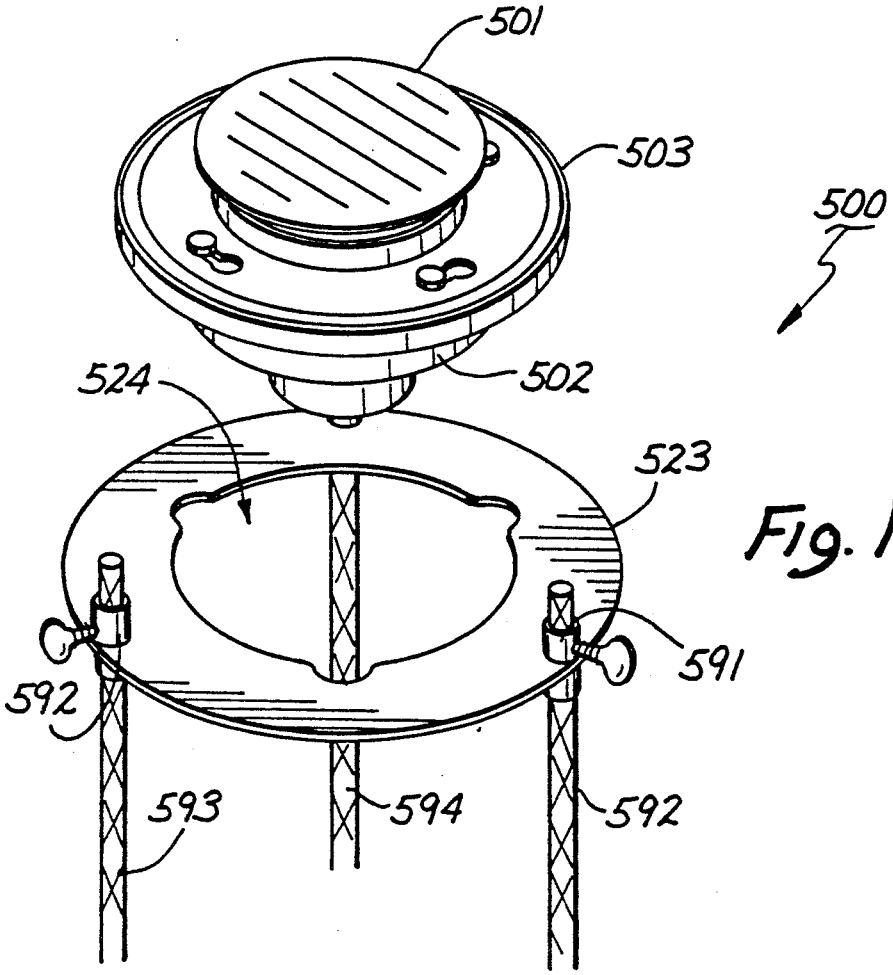
FIG. 10 is a pictorial view of a sixth stabilizer plate configured to stabilize a conventional floor drain on three legs.

FIG. 5 illustrates an apparatus 200 that engages the floor fixture in another way. It is similar in many respects to the apparatus 100 so that only differences are described in further detail. Reference numerals are increased by one hundred over those designating similar parts of the apparatus 100.

Similar to the apparatus 100, the apparatus 200 includes a plate 223 that defines a central opening 224. Unlike the apparatus 100, the apparatus 200 includes a plurality of inwardly extending screw arrangements attached to the plate 223 at spaced apart locations adjacent the central opening 224 that can be adjustably brought to bear inwardly against the body 211 of a floor fixture. They serve as means for coupling the plate to the floor fixture. In addition, the central opening is somewhat larger than the body of the floor fixture with which the apparatus 200 is to be used.

The inwardly extending screw arrangements may take any of various suitable forms within the broader inventive concepts disclosed, but as illustrated each inwardly extending screw arrangement includes a collar attached to the plate 223 and a screw member extending through the collar. In other words, the apparatus 200 includes collars 246–249 and screw members 250–253 extending through them. Preferably, the collars 246–249 are molded with the plate 223 in unitary one-piece construction, and the screws include snap-on pads 254–257 configured in a known way that provide a broad bearing surface against the body of the floor fixture to be stabilized. Installation proceeds in a manner similar to that for the apparatus 100, except that screw member 250–253 are brought to bear inwardly against the body of the floor fixture being installed.

Figure 6:
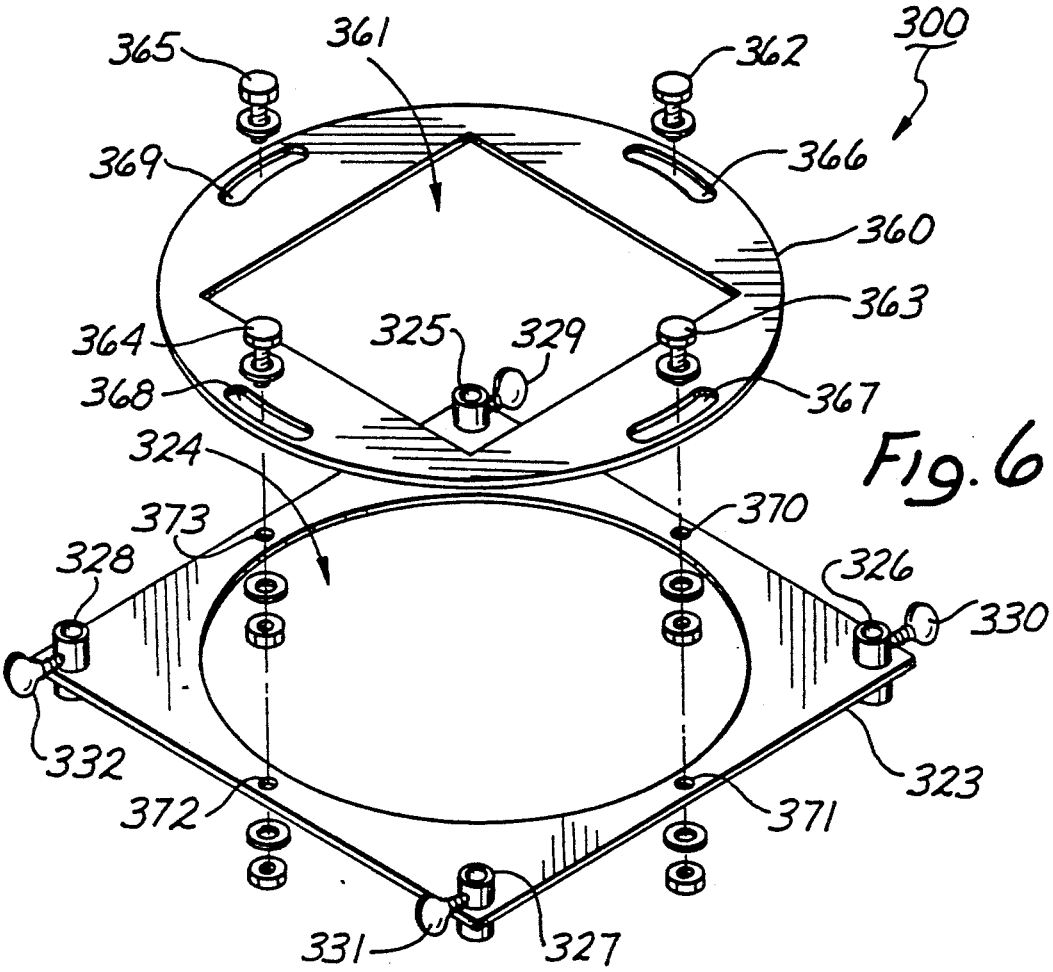
FIG. 6 is a pictorial view of a disassembled fourth stabilizer plate having a baseplate with an adjustably attached adapter/alignment member.
Figure 7:
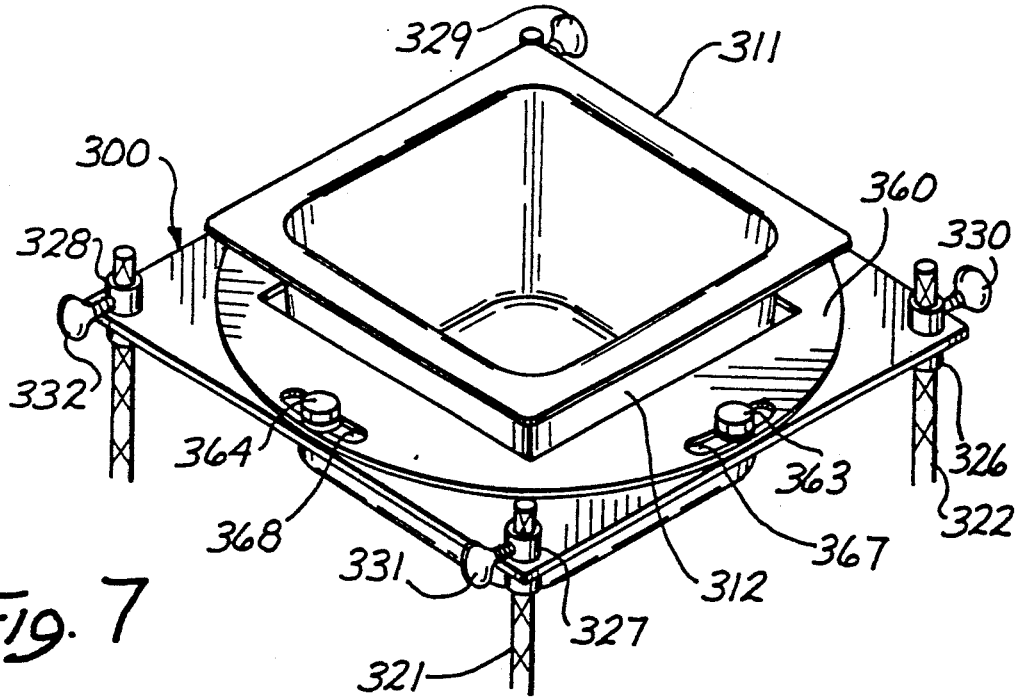
FIG. 7 is a pictorial view of the fourth stabilizer plate installed over the body of a conventional floor sink.

FIGS. 6 and 7 illustrate an apparatus 300 that includes an additional member for coupling the plate to the floor fixture. The apparatus 300 is similar in many respects to the apparatus 10 and reference numerals designating similar parts are increased by three hundred over those used in FIGS. 1 and 2.

Unlike the apparatus 10, the apparatus 300 includes a baseplate 323 that defines a central opening 324 such that the central opening 324 is somewhat larger than the body 311 of a floor fixture to be installed (such as the floor sink 311 in FIG. 7). In addition, the apparatus 300 includes a generally flat second member 360 that defines a smaller opening 361 that is smaller than the central opening 324. The smaller opening 361 has a size and shape that mates with the cross sectional shape of the body 312 of the floor sink 311 so that the second member 360 can be placed over the body 312 of the floor sink 311 to a horizontal position in which the second member 360 abuts the body of the floor fixture. In that regard, the body 312 of the particular floor sink 311 illustrated has rounded corners, and so space appears in FIG. 7 between the corners and the second member 360.

The second member may be composed of a molded plastic material also, and it is attached to the baseplate 323 so that the smaller opening 361 in the second member 360 overlies the central opening 324 in the baseplate 323. Thus, the second member 360 adapts the baseplate 323, and thereby the apparatus 300, to the body 312 of the floor sink 311 and so serves as an adapter plate for coupling the baseplate 323 to the floor sink 311. In addition, the second member 360 is attached to the baseplate 360 adjustably so that it can be pivoted in a horizontal plane in order to align the apparatus 300 with the body 312 of the floor sink 311.

Adjustable attachment may be accomplished in any of various ways, the apparatus 300 having nut-and-bolt arrangements 362–365 extending through elongated openings 366–369 in the second member 360 that are aligned with holes 370–373 in the plate 323. Installation proceeds in much the same as for the apparatus 10, except that the second member 360 is pivoted in a horizontal plane to bring it into alignment with the body 312 of the floor sink 311. Then, the nut-and-bolt arrangements are tightened to secure the second member 360 to the baseplate 323 in that position.

Figure 8:
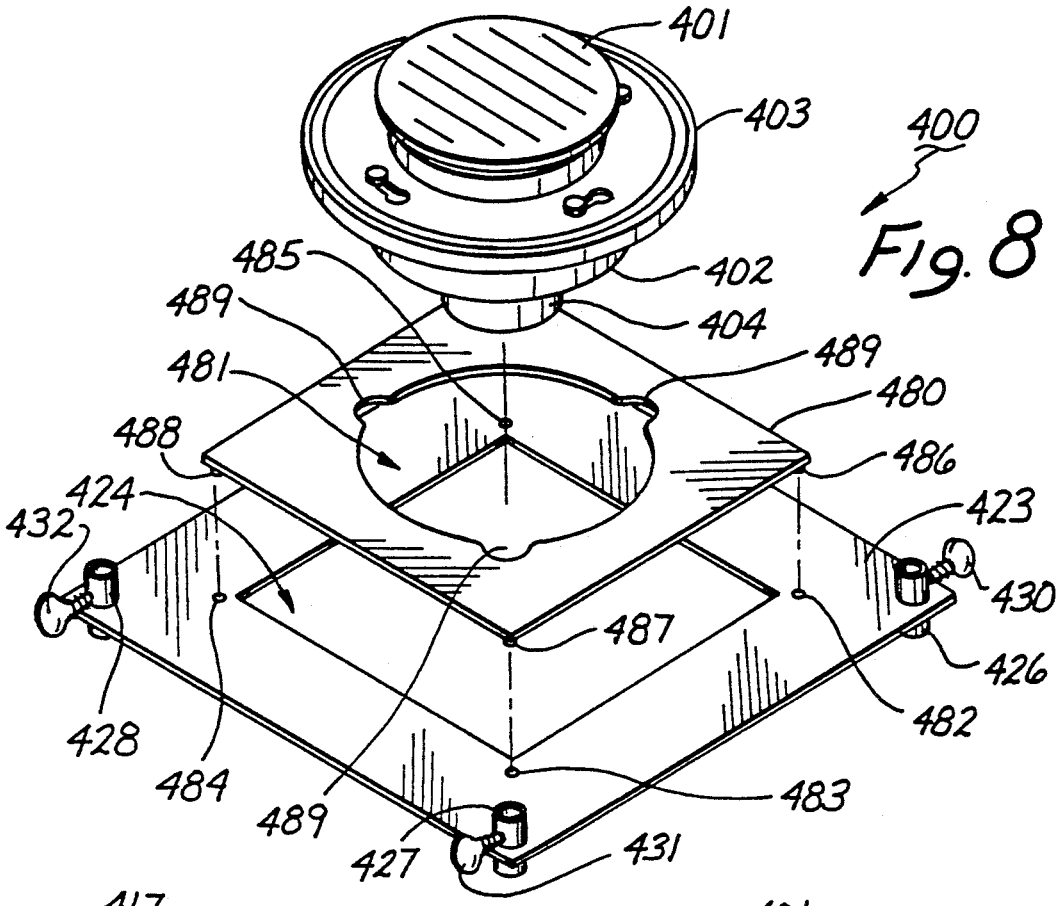
FIG. 8 is a pictorial view of a conventional floor drain and disassembled fifth stabilizer plate having a baseplate with an attached adapter member.
Figure 9:
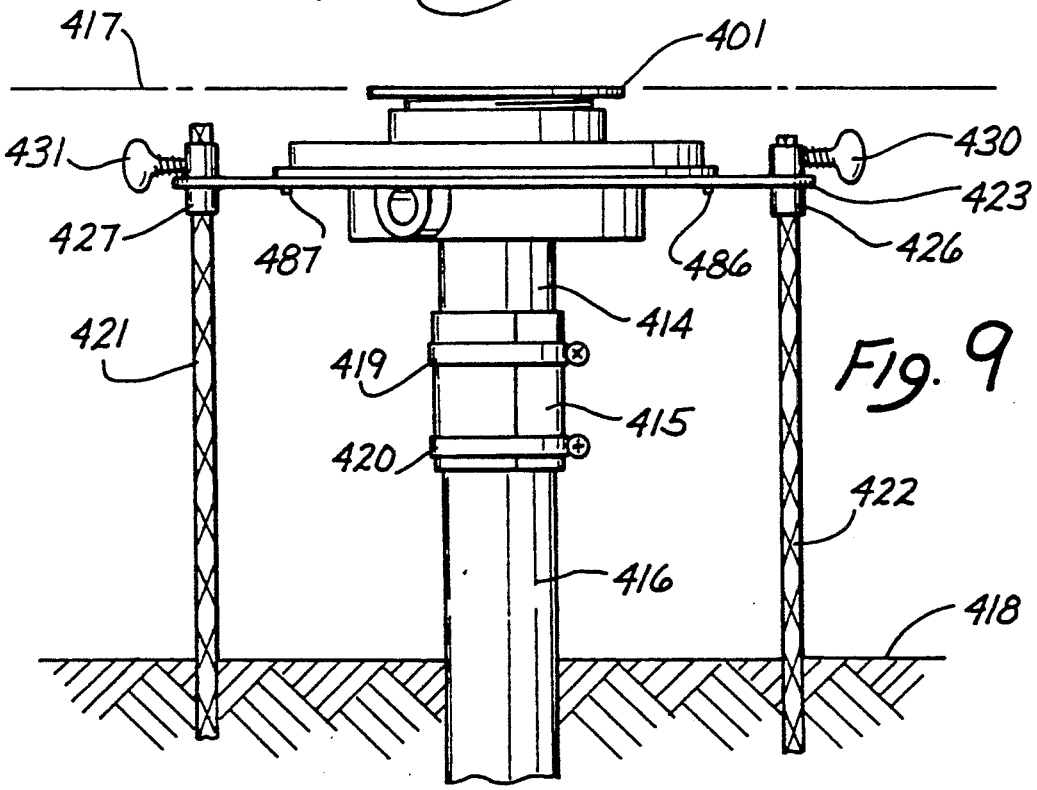
FIG. 9 is an elevation view showing the fifth stabilizer plate installed over the body of a conventional floor drain.

FIGS. 8 and 9 illustrate an apparatus 400 adapted for use in stabilizing a floor fixture in the form of a conventional floor drain 401. The apparatus 400 is similar in many respects to the apparatus 300 and so only differences are described in further detail. Reference numerals are increased by on hundred over those designating similar parts in FIGS. 6 and 7.

The floor drain 401 has a somewhat cylindrical body 402 that extends downwardly from a lip 403 to a drain outlet 404. The floor drain 401 may, for example, take the form of the cast iron floor drain available from Zurn Industries, Inc. of Erie, Pa. that is identified by its Catalog No. Z-415. In that event, the lip 403 measures about 8⅜ inches in diameter and the body 402 has a height between the lip 403 and the bottom of the drain outlet 404 of about three to four inches. Of course, those dimensions may vary within the inventive concepts disclosed, the apparatus 400 being configured according to the precise floor fixture dimensions involved.

Like the apparatus 300, the apparatus 400 includes a baseplate 423 with a central opening 424 that is somewhat larger than the body 404 of the floor drain 401. In addition, the apparatus 400 includes a second member 480 (a counterpart of the second member 360 of the apparatus 300) that adapts the baseplate 423 to the floor drain 401. Unlike the second member 360 of the apparatus 300, however, the second member 480 does not necessarily closely mate the body 402 of the floor drain 401 because it can be used to bear upwardly against the lip 403 of the floor drain 401. That is acceptable in many installations because the lip 403 lies as much as two to three inches below the predetermined floor level 417 when the floor drain 401 is installed.

Instead of attaching adjustably to the baseplate 323, the second member 480 attaches by means of small protrusions that extend into mating holes in the baseplate 423. The apparatus 400 includes four protrusions that extend into holes 482–485, but only protrusions 486–488 are visible in FIG. 8. Of course, other attachement means such as nut-and-bolt arrangements can be employed instead. In addition, the second member 480 may be a molded plastic structure formed with knockout insets that can be removed to form recesses 489 arranged to accommodate protrusions in the body of certain commercially available floor drain models.

FIG. 5 shows yet another apparatus 500 constructed according to the invention. It is similar in some respects to the apparatus 10 and it is configured for use with a floor fixture in the form of a floor drain 501. A plate 523 defines a central opening 524 that receives the body 502 of the drain 501. The central opening 524 fits sufficiently loosely over the body 502 that the plate 523 bears upwardly against a lip 503 of the floor drain 501. Three collars, such as the collars 590 and 591 visible in FIG. 5, mount the plate 523 on three legs 592–594 driven into a floor foundation.

Thus, the invention provides a method and apparatus for installing a floor fixture before the concrete floor is installed. The method and apparatus eliminate the tedious operation of installing and removing protective sand-filled sleeves. They eliminate the cost, inconvenience, and time delays of an additional concrete pouring. They simplify cleanup. The apparatus is easily and inexpensively fabricated, and installation can proceed using readily available lengths of steel reinforcing bar driven into the floor foundation.

Although exemplary embodiments have been shown and described, many changes, modifications, and substitutions may be made by one having ordinary skill in the art without necessarily departing from the spirit and scope of the invention.

What is claimed is:

1. A method of installing a floor fixture, comprising:

providing a support structure for stabilizing the floor fixture relative to a floor foundation at an installation location, the support structure extending upwardly from the floor foundation;

coupling the floor fixture to a drainpipe at the installation location before a concrete floor is poured on the floor foundation;

stabilizing the floor fixture with the support structure; and pouring a concrete floor on the floor foundation while the support structure stabilizes the floor fixture; thereby covering the support structure with the concrete floor.

2. A method of installing a floor fixture, comprising:

providing a support structure for stabilizing the floor fixture relative to a floor foundation at an installation location, which support structure includes a plurality of legs adapted to be driven into the floor foundation and an apparatus that is configured to fit over the body of the floor fixture and mount on the legs in order to restrain the floor fixture from moving relative to the floor foundation;

coupling the floor fixture to a drainpipe at the installation location before a concrete floor is poured on the floor foundation at that location;

stabilizing the floor fixture with the support structure so that the support structure is entirely below the predetermined floor level, including driving the legs into the floor foundation and connecting the apparatus to the legs so that the apparatus is in a position that restrains the floor fixture from moving; and pouring a concrete floor on the floor foundation while the support structure stabilizes the floor fixture, thereby covering the support structure with the concrete floor.

3. An apparatus for stabilizing a floor fixture, comprising:

means for coupling the body of a floor fixture installed at an installation location to a plurality of legs extending to a floor foundation at the installation location;

the means for coupling including a plate having a central opening that mates with the cross sectional shape of the body of the floor fixture so that the plate can be placed over the body of the floor fixture to a horizontal position in which the plate abuts the body of the floor fixture; and the means for coupling including means for adjustably mounting the plate in such a position on the plurality of legs.

4. An apparatus as recited in claim 3, wherein the central opening has a size and shape such that the plate can be placed in such a position over the body of a conventional floor sink.

5. An apparatus as recited in claim 3, wherein the central opening has a size and shape such that the plate can be placed in such a position over the body of a conventional floor drain.

6. An apparatus as recited in claim 3, wherein the plate defines a plurality of smaller openings for receiving the legs.

7. An apparatus as recited in claim 6, wherein the means for adjustably mounting the plate in such a position on the plurality of legs includes means for securing each leg within one of the openings.

8. An apparatus as recited in claim 3, wherein the means for adjustably mounting the plate in such a position on the plurality of legs includes a plurality of collars attached to the plate, each collar having a set screw for securing one of the legs within the collar.

9. An apparatus as recited in claim 8, wherein the plate is composed of a molded plastic material and the collars are attached to the plate in unitary one-piece construction.

10. An apparatus as recited in claim 3, wherein the means for adjustably mounting the plate in such a position on the plurality of legs is configured to function with legs in the form of sections of conventional reinforcing bar driven into the floor foundation.

11. An apparatus for stabilizing a floor fixture, comprising:

means for coupling the body of a floor fixture installed at an installation location to a plurality of legs extending to a floor foundation at the installation location;

the means for coupling including a plate having a central opening such that the plate can be placed over the body of the floor fixture to a horizontal position in which the body of the floor fixture extends through the central opening;

the means for coupling including means for adjustably mounting the plate in such a position on the plurality of legs; and the means for coupling including means for coupling the plate to the floor fixture.

12. An apparatus as recited in claim 11, wherein the means for coupling the plate to the floor fixture includes a plurality of upwardly extending screw arrangements attached to the plate at spaced apart locations adjacent the central opening such that the screw arrangements can be adjustably brought to bear upwardly against an underside of a lip on the floor fixture.

13. An apparatus as recited in claim 11, wherein the means for coupling the plate to the floor fixture includes a plurality of inwardly extending screw arrangements attached to the plate at spaced apart locations adjacent the central opening such that the screw arrangements can be adjustably brought to bear inwardly against the body of the floor fixture.

14. An apparatus as recited in claim 11, wherein the means for coupling the plate to the floor fixture includes:

a generally flat second member that defines a smaller opening than the central opening in the plate, the smaller opening having a size and shape that mates with the cross sectional shape of the body of the floor fixture so that the second member can be placed over the body of the floor fixture to a horizontal position in which the second member abuts the body of the floor fixture;

the second member being attached to the plate in a position such that the smaller opening overlies the central opening in the plate.

15. An apparatus as recited in claim 14, wherein the second member is adjustably attached to the first member to enable alignment of the smaller opening with the body of the floor fixture.

16. An apparatus as recited in claim 14, wherein the smaller opening has a size and shape that mates with the shape of the body of a conventional floor sink.

17. An apparatus as recited in claim 14, wherein the smaller opening has a size and shape that mates with the shape of the body of a conventional floor drain.

* * * * *